US008733806B2

(12) United States Patent
Kuppelwieser et al.

(10) Patent No.: US 8,733,806 B2
(45) Date of Patent: May 27, 2014

(54) ACTUATING HANDLE

(75) Inventors: Stefan Kuppelwieser, Laas (IT); Stefan Holzknecht, Schluderns (IT); Heinz-Eckhard Engel, Glurns (IT)

(73) Assignee: Hoppe AG (IT)

( * ) Notice: Subject to any disclaimer, the term of this patent is extended or adjusted under 35 U.S.C. 154(b) by 7 days.

(21) Appl. No.: 12/685,092

(22) Filed: Jan. 11, 2010

(65) Prior Publication Data

US 2010/0225129 A1 Sep. 9, 2010

(30) Foreign Application Priority Data

Jan. 12, 2009 (DE) ..... 20 2009 000 422 U

(51) Int. Cl.
*E05B 3/00* (2006.01)

(52) U.S. Cl.
USPC ..... 292/336.3

(58) Field of Classification Search
CPC ..... E05B 85/16; E05B 63/0056; E05B 3/003
USPC ..... 292/336.3, 347, 348, DIG. 53, DIG. 54, 292/DIG. 64, 1, 336.5, 349; 70/224
See application file for complete search history.

(56) References Cited

U.S. PATENT DOCUMENTS

| | | | | | |
|---|---|---|---|---|---|
| 1,899,997 | A | * | 3/1933 | Sullivan | 70/222 |
| 1,910,125 | A | * | 5/1933 | Root | 74/556 |
| 2,273,632 | A | * | 2/1942 | Floraday | 464/39 |
| 2,469,601 | A | * | 5/1949 | Lee | 292/202 |
| 2,657,083 | A | * | 10/1953 | Krohm | 403/357 |
| 3,007,726 | A | * | 11/1961 | Parkin | 403/372 |
| 3,222,951 | A | * | 12/1965 | Maursey | 74/543 |
| 3,314,708 | A | * | 4/1967 | Welch | 292/336.5 |
| 4,550,581 | A | * | 11/1985 | Best et al. | 70/422 |
| 4,773,240 | A | * | 9/1988 | Foshee | 70/222 |
| 6,527,314 | B2 | * | 3/2003 | Brown | 292/336.3 |

FOREIGN PATENT DOCUMENTS

| | | | |
|---|---|---|---|
| DE | 8802929 U1 | | 5/1988 |
| DE | 8 802 929 | * | 6/1988 |
| EP | 0330937 | * | 9/1989 |

* cited by examiner

*Primary Examiner* — Kristina Fulton
*Assistant Examiner* — Nathan Cumar
(74) *Attorney, Agent, or Firm* — Reinhart Boerner Van Deuren s.c.

(57) ABSTRACT

An actuating handle for a window or door including a fixing element coupled to a socket, the socket being selectively rotatable relative to a stop plate. The fixing element will allow insertion of a polygonal driver coupled to a handle from one direction through the socket, thereby rotationally coupling the handle and the socket, but will not allow the polygonal driver to be withdrawn in the opposite direction.

16 Claims, 6 Drawing Sheets

ACTUATING HANDLE

IDENTIFICATION OF RELATED APPLICATIONS

This patent application claims priority to German Application DE 20 2009 000 422.8, filed on Jan. 12, 2009, which is entitled "Actuating Handle," and which is assigned to the owner of the present application, and which patent application is hereby incorporated herein by reference in its entirety.

BACKGROUND OF THE INVENTION

Field of the Invention

The present invention relates generally to an actuating handle.

Actuating levers for construction components such as doors and windows usually have a handle, which is mounted on the level of the stop plate (rosette), is axially rotatable and, via a driver, e.g., a square pin, is adapted to turn an actuating device in the window or the door, such as a window tilt gear mechanism or a spindle hub.

In the case of window handles, the handle is usually irrotationally connected to a socket, which is supported on the inner surface of the stop plate so that any tensile forces applied to the handle are transferred to the underside of the stop plate. On the circumference of the socket are formed arresting indentations to interact within the locking elements to define functional positions of the window handle (See, for example, DE-U1-299 22 496).

The assembly of the actuating handle on doors or windows is always problematic when the handle is already factory connected to the stop plate, for example, using flanging, riveting or a retaining ring. Especially with window handle sets, however, during the attaching of the stop plate to the front of the window sash the handle is generally placed in front of the attachment screws, which are only accessible when the handle is pivoted during the screwing or if the appropriate tool is oblique. A further difficulty arises when the stop plate of the rosette is provided with a cap to conceal the mounting screws. Although the cap may be generally laterally pivoted to expose the bolts for this purpose—depending on the installation situation—there may be a lack of space, for example in the case of hopper windows, which are open towards the outside and where the stop plate is arranged along the edge. Overall, the attachment is therefore tiresome and cumbersome.

To avoid these disadvantages, it is a known practice to design the handle and the stop plate separately and to provide a catch device between the aforementioned components, which allows the one-site assembly of the handle with the stop plate. The latter is first screwed without the handle to the window and provided with a covering cap if need be. Then the handle with its grip neck and the driver is inserted into the mounting plate, with the catch device generating an axially rotatable connection.

For example, DE-U1-298 01 858 uses, as a catch device, radially elastically extendable support-flange section, which are distributed at intervals over the circumference of a through opening in the mounting plate. The individual arresting sections are radially spread when the grip neck is being inserted and then a rest, due to their inherent elasticity, in a circumferential latching groove of the grip the neck.

EP-B1-022 413 discloses a mounting plate with a central socket, which is provided at its inner periphery with a circumferential groove. In it, a snap ring is inserted, whose inner diameter is smaller than the inside diameter of the socket. If one inserts the handle with its grip neck into the socket, the retaining ring is initially spread apart and locked again upon the handle reaching a defined end position, the grip neck being also provided with a circumferential latching groove.

The disadvantage here is that these known solutions mostly have many components and often require complicated tools. Therefore, they are overall complicated expensive to manufacture. Also, the handling is not always easy.

The goal of the invention is therefore to overcome the disadvantages of the prior art by providing an alternative mounting solution. The endeavor is, in particular, to design an actuating handle, which is inexpensive to make and can be assembled in a both simple and fast fashion. In addition, the connection is to withstand higher loads without problems.

SUMMARY OF THE INVENTION

For a control handle for windows and/or doors, with a grip that is axially rotatably mounted on or in a stop plate, where the front side of the grip has a recess into which an actuating polygon is axially mounted, and with a socket that is supported on the inside of the stop plate and is torque-proof connected with the grip, the invention provides that the socket is equipped with a fixation element that fixes the actuating-polygon in the axial direction.

Due to that arrangement, the actuating polygon is connected, through the fixation element, to the socket and the latter is connected through the polygonal driver to the grip, which is thus mounted axially irrotationally in the stop plate. The entire actuating handle consists of only a few components, which are simple and can be handled quickly and easily. But the assembly, too, is very simple because only the actuating polygon must be plugged into the socket, until the grip finds its stop at the stop plate. The fixing element provides a permanent, reliable, and stable fixing of the handle in the stop plate.

This is helped especially if the fixing element is configured in such a fashion that the insertion of the polygon into the socket is possible in a first direction and locked in the opposite direction. Therefore, the grip can be mounted without any great effort, but it cannot be released again from the stop plate. In particular, it is possible to slip the grip, without any tools, on the stop plate already mounted on the wing frame, when already during the slipping an axially rotating connection is formed that cannot be released again.

The fixing element is preferably a toothed ring, which has indentations in its inside circumference, which are effective against a first direction in which the grip is pulled. The indentation can be engaged in a positive locking with the polygon, which ensures a permanent, stable, and reliable connection.

Another important embodiment of the invention provides that the fixing element is positively connected to the socket. The fixing element is thus part of the socket and, therefore, part of a whole assembly. Therefore, it does not need to be separately assembled by the customer or by the local craftsmen. The socket is again semi-assembled in the stop plate so that, after installation of the stop plate, a craftsman must only insert the grip with the actuating polygon into the socket.

The toothed ring secures the grip in the axial direction away from the window, while the torque for actuating the locking mechanism of the tilt and turn window is transmitted to the socket from the actuation polygon through an identical shape and identical axis through hole in the socket. The toothed ring with its razor-sharp punching ridges and the spring-steel elastic material properties also ensures an axially adjustable grip assembly and an axially secure hold in the opposite direction.

Alternatively, the fixing element can be cohesively connected to the socket. Or one can design the fixing element and the jack as one piece. It is important that the fixing element is an integral part of the socket and forms with it a pre-assembled unit.

Between the socket and the fixing element, there is suitably designed an anti-twist mechanism to ensure a consistently reliable installation.

The socket is preferably a detent socket, which cooperates with locking elements, and these are formed on or in the stop plate.

A stable and accurate mounting of the socket and thus of the grip is achieved in that the stop plate has a neck, which receives the socket and/or—if the handle is fitted with a neck grip—the grip neck in a rotation-allowing fashion. If the socket is flush with the neck, there arises an essentially flat support surface for the grip. If the grip neck projects into the neck of the stop plate, the grip neck seats solidly flat and flush on the socket, which is supported from the inside edge on the circumference of the neck lug so that the grip, here too, is connected to the stop plate through the actuating square pin, the toothed rind, and the socket and cannot rotate.

To hide the mounting screws for the stop plate, it is fitted with a cover, which is latched to the stop plate.

Further features, details, and advantages of the invention are apparent from the wording of the claims and from the following description of exemplary embodiments with reference to the drawings.

DETAILED DESCRIPTION OF THE EXEMPLARY EMBODIMENTS

Figure 1:
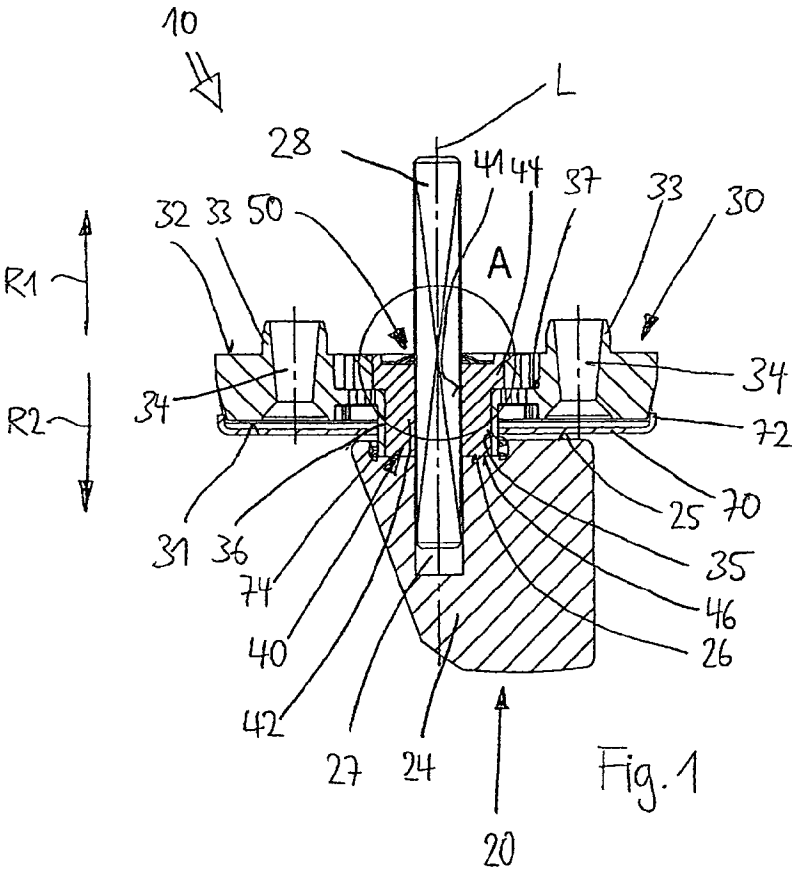
FIG. 1 shows a partial sectional view of an actuating handle with a handgrip mounted on a stop plate.

It may therefore be appreciated from the detailed description of the exemplary embodiments of the present invention that the actuating handle in FIG. 1, generally designated with 10, is formed as a window handle set for a tilt-and-turn window (not shown). It has a handle 20 with a (not shown) handgrip 22 and an adjoining grip head 24, which is, after the assembly of the actuating handle 10, rotatably mounted in a fixed axial position on a stop plate 30. A polygon driver 28 that is tightly connected to the grip 20 is used to actuate a locking mechanism (not shown) of the tilt-turn window. The stop plate 30 has a socket 40 that is rotatably arranged and which is supported in an inner surface 37 of stop plate 30 and —also after the installation of the operating handle 10 —by means of an axially fixing element 50 (also referred to in one preferred embodiment as toothed ring 50) contacting the polygonal driver 28, irrotationally and axially fixedly connected with the handle head 24, whereby the handle 20 is axially fixed but rotatable on the stop plate 30.

The stop plate 30 is attached by means of screws (not shown) on a wing frame of the tilt-and-turn window. It has a flat top surface 31 and protruding cams 33 on a parallel bottom surface 32, which are penetrated by threaded holes 34. At the stop plate 30, there is centrally provided a cylindrical recess 35, which comprises a neck lug 36 that protrudes over the top surface 31 to retain the rotating socket 40.

Figure 2:
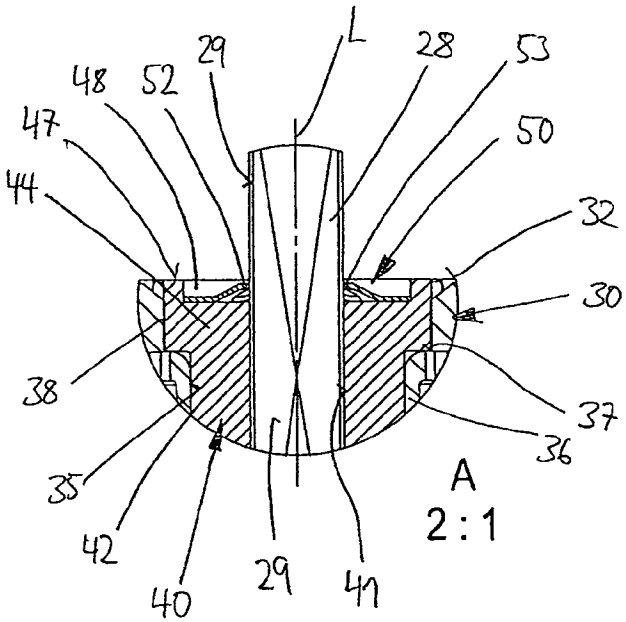
FIG. 2 shows an enlarged detail of FIG. 1.
Figure 4:
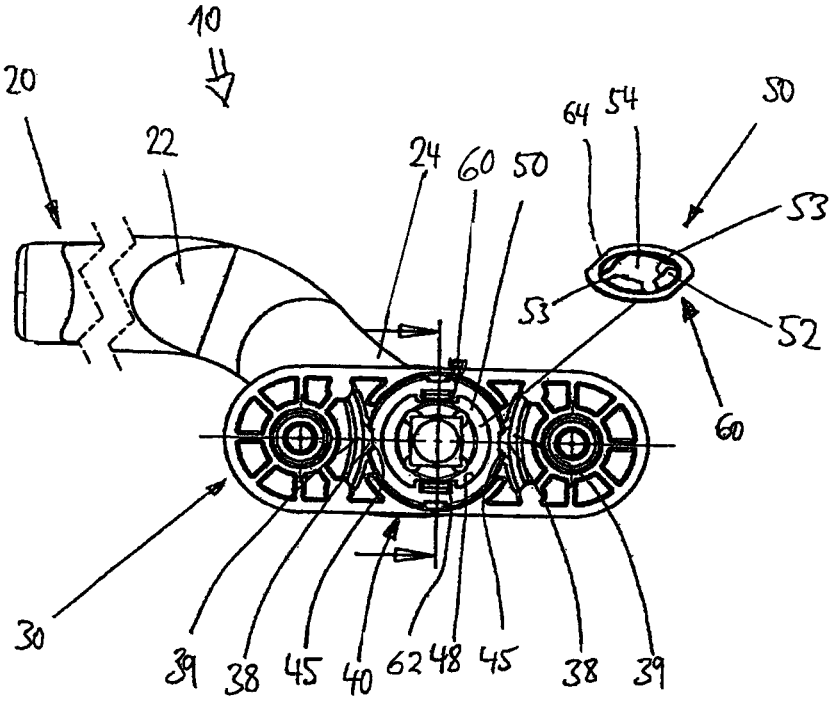
FIG. 4 shows a view of the actuating handle of FIG. 1 from below.

As shown in detail in FIG. 2, the socket 40 is designed as a detent socket. It has a main cylindrical part 42, which is mounted in the recess 35 in the neck lug 36 of the stop plate 30 with a minimum range of motion. A broader collar 44 following the main part 42 serves to support the socket 40 on the inner surface 37 of stop plate 30. It is provided with circumferential arresting recesses 45, which correspond with latching projections 38. The latter are formed in the stop plate 30. They engage in the displayed rotational positions of the handle 20 into the arresting recesses 45 of the detent socket 40 to mark the functional positions of the handle 20 (see FIG. 4). The locking projections 38, formed opposite one another, are preferably formed as one piece with the stop plate 30 and are arranged on the spring pins 39.

It can be seen in FIG. 1 that the socket 40 with its grip 20 facing the end surface 46 is flush with the neck lug 36 of the stop plate 30. The socket 40 and the neck lug 36 thus form an essentially flat and sliding surface for the grip head 24, which has a favorable effect on the mounting and conduct of the grip 20. The front surface 47 of the socket 40 facing the window is flush with the bottom surface 32 of the stop body 30 so that, after the sinking of the cams 33, both components lie flat on the wing frame of the window. The socket 40 is thus reliably conducted between the stop plate 30 and the wing frame.

As shown particularly in FIG. 2, a central recess or depression 48 is formed in the front surface 47 of the socket 40. This serves the purpose of receiving the fixing element 50, which fixes the polygonal driver 28 and thus creates in the axial direction a connection between the grip 20 and the socket 40.

As for the fixing element 50, this is preferably a toothed ring that has a centered recess 54, on whose inner periphery there are a number of teeth 52 that project both perpendicularly with the axial direction L and in a first direction R1. This ensures that the insertion of the polygonal driver 28 into the socket 40 and through the toothed ring 50 is possible in a first direction R1, whereas however, it is blocked in the opposite direction R2, because when pulling on the grip 20 the slanted teeth 52, due to their sharp edges 53, cut in the opposite direction R2 into the material of the polygonal driver 28. The teeth 52, preferably fitted with straight cutting edges 53, firmly engage with the side faces 29 of the polygonal driver 28, fixing it in the socket 40 without any looseness. Pulling the grip 20 from the socket 40 is no longer possible.

In order to guarantee a non-rotatable connection between the polygonal driver 28 and the socket 40, the latter is fitted with an angular through recess 41, which positively receives the polygonal driver 28.

Fixing the toothed ring 50 in the socket 40 is preferably achieved by a positive connection, such as by caulking. To this end, the inside diameter of the recess 48 is slightly smaller than the outside diameter of the toothed ring 50. However, one can connect the toothed ring 50 also cohesively with the socket 40, for example, by gluing.

In order for toothed ring 50 not to be able to rotate within the recess 48 with respect to the socket 40 and to ensure that after mounting the recess delimited by the cutting edges 53 of the toothed ring 50 (not shown) lies congruent to the through recess 41 of the socket 40, an anti-rotation arrangement 60 is arranged between the socket 40 and toothed tooth 50. This arrangement is composed of key faces 62 and the corresponding key edges 64, that are formed on the sides of the recess 48 of the socket 40 and on the sides of the toothed ring 50. If one inserts the toothed ring 50 into the recess 48, the preferably straight key edges 64 of the toothed ring 50 align with the key faces 62 in the recess 48. This secures congruent position of the through recess 41 of the socket 40 and the centered recess 54 of the toothed ring 50.

Between the grip head 24 and the stop plate 30, there is a cover 70, which is rotation-proof and supported with a peripheral edge 72 by the stop plate 30, and engages in particular with the latter. The cover 70 has a central recess (not marked) for receiving the neck 36 of the stop plate 30. It is designed as one piece with a spring 74, which, when the grip 20 is in mounted position, is supported by the lower end face 25 of the grip head 24 and secures the cover 70 in its locking position on the stop plate 30. In the end face 25 of the grip head 24, there is defined a recess 26, which concentrically receives the spring 74 and the neck 36 of the stop plate 30, whereby the grip head 24 is located relatively close over the cover 70. The spring 74 can, if desired, also be formed separately from the cover 70.

As FIG. 1 further shows, another recess 27—which is rectangular in cross section and is central to recess 26, is placed in the grip head 24. This is intended to be used for a positive reception of the actuating polygonal driver 28, which is axially inserted into the recess 27 creating an irrotational connection, for example by pressing and/or by gluing.

Figure 3:
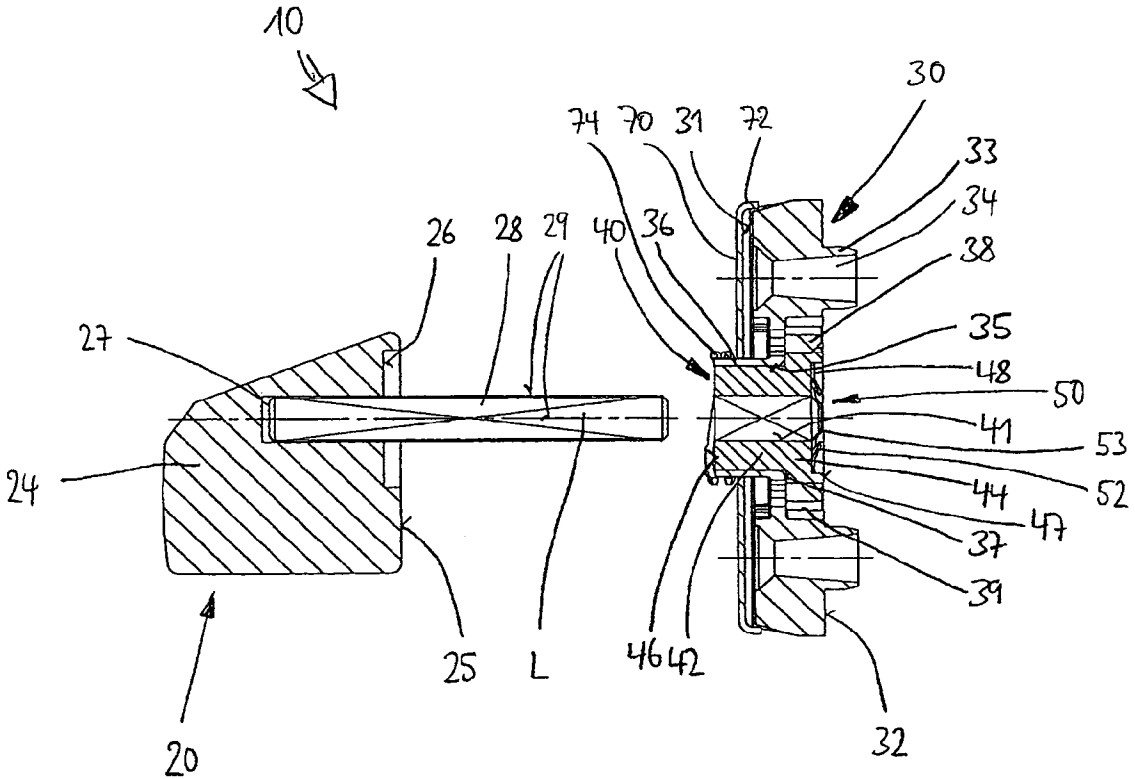
FIG. 3 shows a partial sectional view of the actuating handle of FIG. 1 before assembly of the handgrip on the stop plate.

FIG. 3 shows the window grip set 10 before the assembly in a window frame. The handle 20 with the polygonal driver 28 forms a first component, while the stop plate 30 with the employed socket 40 forms a second assembly.

When assembling the handle 10, first the second module is attached to the closed wing frame by putting the stop plate 30 with the socket 40 onto the wing frame and bolting it. Subsequently, the cover 70 is placed axially onto the base of the neck 36 of the stop plate 30 and engaged with it. When the second module is mounted, the first module may be joined by inserting the polygonal driver 28 through the socket 40 and the toothed ring 50 into the stop plate 30 until the grip head 24 is leaning against the neck 36 and the end surface 46 of socket 40. During the fitting process the polygonal driver 28 bends the teeth 52 in the toothed ring 50 in the direction R1, wherein the edges 53 slide on the side faces 29 of the polygonal driver 28. If, by contrast, one pulls the grip 20 and thus the polygonal driver 28 back against the direction of R1 in the direction R2, the teeth 52 engage with their sharp cutting edges 53 with the polygonal driver 28 so that it is so immediately fixed. The polygonal driver 28 and the grip 20 are thus axially fixed through the socket 40, which is rotatably supported by the stop plate 30.

It is important that the socket 40 and the fixing element 50 form a pre-assembled unit. This ensures not only a good production of all components. The assembly and the handling are also significantly simplified. The entire set 10 consists of only a few components that can be inexpensively manufactured because of its simple geometry. In addition, the toothed ring 50 is, together with the socket 40, part of the second component assembly.

Figure 5:
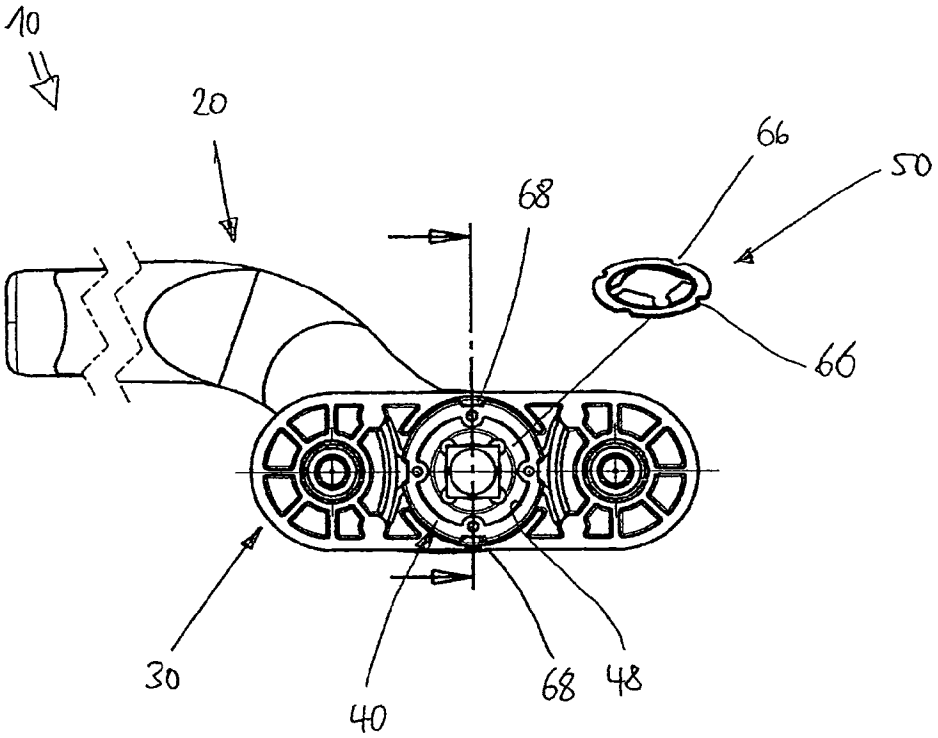
FIG. 5 shows another embodiment of an actuating handle.

The embodiment of an actuating handle shown in FIG. 5 essentially has the same structure as the actuating lever of FIGS. 1 to 4. Only the circumference of the toothed ring 50 is provided with four recesses 66 instead of two opposing key edges 64, which are mounted on corresponding protrusions 68 within the recess 48. Such an embodiment is so far assembly-friendlier (at the factory pre-assembly) in that the toothed ring 50 can be inserted (and fits) every 90 degrees rather than just every 180 degrees into the detent socket.

Figure 6:
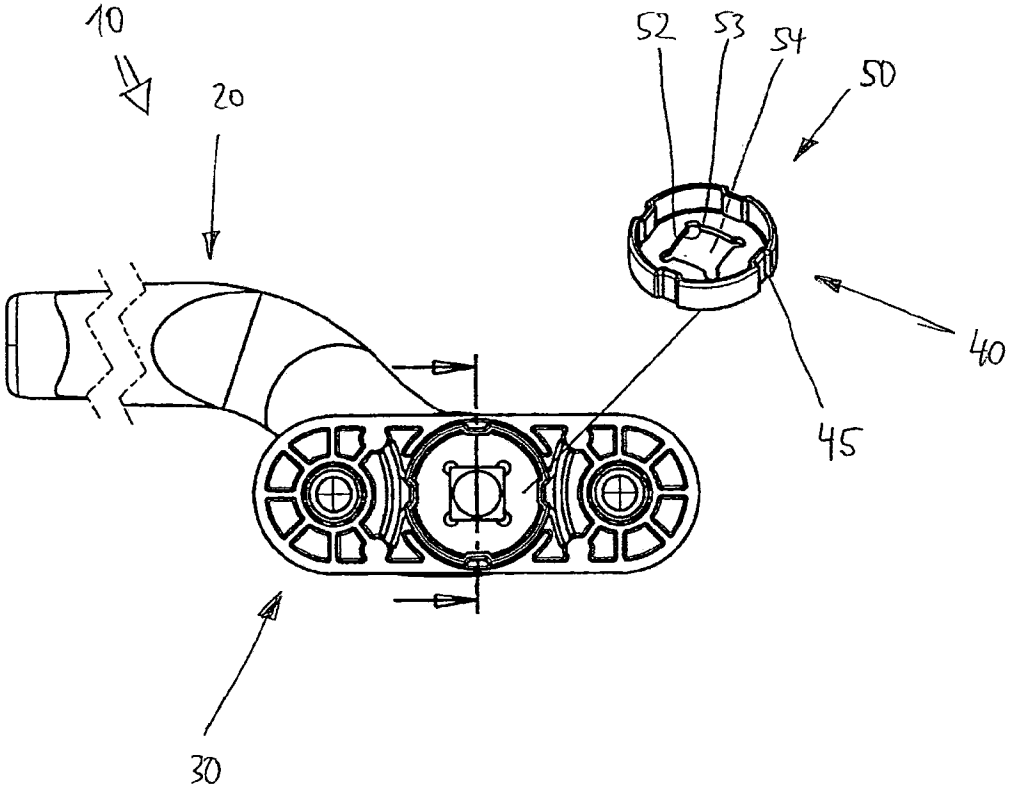
FIG. 6 shows a further embodiment of an actuating handle.

In the representation of the FIG. 6, the detent socket 40 and the toothed ring 50 are formed as one piece. To this end, the detent socket 40 is carried out as a dropped cup, whose outer circular cylindrical frame is profiled with axially extending arresting recesses 45, and whose bottom has the described the toothed ring punch contour with the teeth 52 and the cutting edges 53.

Figure 7:
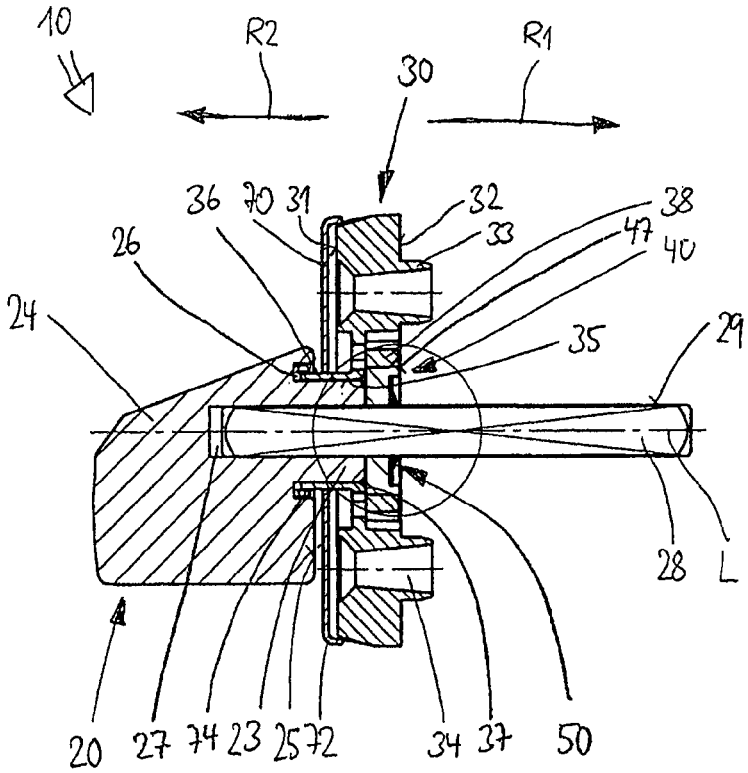
FIG. 7 shows a partial sectional view of yet another embodiment of an actuating handle with handgrip mounted on a stop plate.

FIG. 7 shows a further embodiment of an actuating handle 10 as designed by the invention. Again, it is designed as a window handle set for a tilt-and-turn window. It has a handgrip 20 with a grip main body 22 and an adjoining grip head 24 with a grip neck 23, which after the assembly of the actuating handle 10 is axially rotatable in a stop plate 30. A polygonal driver 28 connected to the grip 20 and the grip neck 23 serves the purpose of actuating the locking mechanism of the tilt-and-turn window. Within the stop plate 30 a socket 40 is rotatably mounted, which is supported by the inner surface 37 of stop plate 30, and which is—similarly after the assembly of the actuating lever 10—connected in an axially fixed and torque-proofed manner with the grip head 24 and the grip neck 23 by the polygonal driver 28 through the axial fixing element 50, so that grip 20 is axially fixed but rotatable, in the stop plate 30.

The stop plate 30 is attached by screws onto the wing part of the tilt-and-turn window. It has a flat cover surface 31 and, on a parallel bottom surface 32, protruding cam 33, which are perforated by screw holes 34. On the stop plate 30, there is centrally provided a cylindrical recess 35, which comprises a neck 36 that protrudes over the cover surface 31 and serves the purpose of retaining the grip neck 23.

Figure 8:
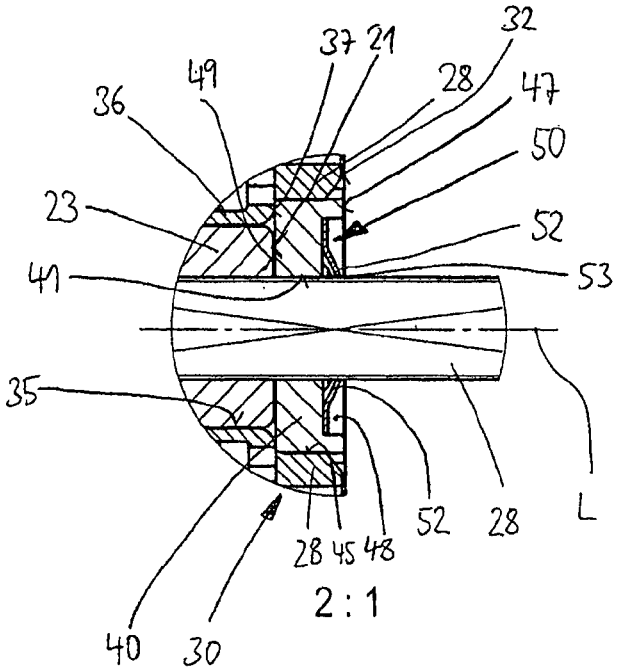
FIG. 8 shows an enlarged detail of FIG. 7.

The socket 40, as shown in FIG. 8 in more detail, is designed as a detent socket and essentially in the shape of a disc. It is supported by the inner surface 37 of the stop plate 30 along the circumferential edge of the collar lug and on its circumference it is equipped with arresting recesses 45 that correspond with latching projections 38. The latter are formed in the stop plate 30. They engage in the marked rotational positions of the handgrip 20 into the arresting recesses 45 of the detent socket 40, in order to mark the functional positions of the grip 20 (See FIGS. 4 to 6). The locking projections 38 are formed opposite one another and are preferably made as one piece with the stop plate 30 and the spring pins 39.

It can be seen in FIGS. 7 and 8 that the grip neck 23 is conducted in the recess 35 with the neck lug 36 with low range of motion rests flush with its flat face 21 against the back surface 49 of the socket 40 which, in turn, leans with its rear surface 49 on the inner surface 37 the stop plate 30, which results in an equally stable and accurate mounting and control of the grip 20. The front surface 47 of the socket 40 facing the window is flush with the bottom surface 32 of the stop body 30 so that, after the sinking of the cams 33, both components lie flat on the wing frame of the window. The socket 40 is thus reliably conducted between the stop plate 30 and the wing frame.

As shown particularly in FIG. 8, a central recess or depression 48 is placed in the front surface 47 of the socket 40 facing the window. This serves to receive the fixing element 50, which fixes the polygonal driver 28 in the axial direction L and thus establishes an axially firm connection between the grip 20 and the socket 40.

The fixing element 50 corresponds, in its structure and function, to the fixing element shown and explained in FIGS. 1 to 6.

The invention is not limited to the embodiments described above; rather, it can be modified in many ways. However, one realizes that an actuation handle 10, in particular a rotating handle for windows and/or doors, comprises a grip 20, which is mounted axially on or in a stop plate 30. The grip 20 has a recess 27 on the front side, into which a polygonal driver 28 is inserted in an axially firm fashion. Within the stop plate 30, there is mounted, in a rotatable manner, a socket 40, whereby the socket 40 is supported with a collar 44 inside the stop plate 30. The socket 40 is further axially and irrotationally connected to the grip 20. To this end, a fixing element 50 is provided, which, as an integral part of the socket 40, fixes the polygonal driver 28 in the axial direction L.

This makes it possible to plug the grip 20 into the plate 30 which is already mounted on the wing frame without any tools, wherein after the plugging an axially firm, rotating connection arises, because the fixing element 50 is configured such that the insertion of the polygonal driver 28 into the socket 40 is possible in a first direction R1 and locked in an opposite direction R2. The toothed ring 50 thus secures the grip 20 in the axial direction of pulling R2 away from the window. The torque for the actuation of the locking mechanism of the tilt-and-turn window is transmitted from the polygonal driver 28 through a same-form and same-axis axial hole 41 in the socket.

The toothed ring 50 is part of the detent socket 40. It is lodged on the underside into a corresponding axial recess 48 and then axially caulked. Lateral key edges 64 and recesses 66 act as anti-rotation protection and secure the congruent angle position of the through recess 41 of the detent socket 40 and the centered recess 54 of the toothed ring 50. This ensures a safe mounting of the grip 20, wherein its side faces 29 slide through the corresponding through recess 41 of detent socket 40 slides and passes through the hook-like teeth 52 of the toothed ring 50. This should be ensured, with their razor-sharp edge 53 and the spring-steel elastic material properties, an axially adjustable grip assembly and an axially secure hold in the opposite direction.

All features and advantages that become obvious from the claims, the description and the drawing, including constructive details, spatial arrangements and procedural steps, can be essential to the invention both individually and in various combinations.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

LIST OF REFERENCE NUMBERS

| | |
|---|---|
| L | Axial direction |
| R1 | Direction |
| R2 | Direction |
| 10 | Actuating handle |
| 20 | Handle/grip |
| 21 | Face surface |
| 22 | Main part of the grip |
| 23 | Grip neck |
| 24 | Grip head |
| 25 | Lower end face of grip head |
| 26 | Recess in end face of grip head |
| 27 | Recess |
| 28 | Polygonal driver |
| 29 | Side faces |
| 30 | Stop plate |
| 31 | Top surface |
| 32 | Bottom surface |
| 33 | Cams |
| 34 | Threaded hole |
| 35 | Cylindrical recess |
| 36 | Neck lug |
| 37 | Arresting protrusion |
| 38 | Locking projection |
| 39 | Spring bar |
| 40 | Socket |
| 41 | Through recess |
| 42 | Main cylindrical part of socket |
| 44 | Collar |
| 45 | Arresting recess |
| 46 | End surface |
| 47 | Front surface |
| 48 | Recess |
| 49 | Rear face |
| 50 | Axially fixing element |
| 52 | Tooth |
| 53 | Edge |
| 54 | Centered recess |
| 60 | Anti-rotation arrangement |
| 62 | Key faces |
| 64 | Key edges |
| 66 | Recesses |
| 68 | Protrusion |
| 70 | Cover |
| 72 | Peripheral edge |
| 74 | Spring |

What is claimed is:

1. An actuating handle for one of windows and doors, the actuating handle comprising:

a stop body;

a grip axially fixed and rotatably mounted one of on and in the stop body; wherein the grip defines a recess;

a polygonal driver configured to be axially inserted into and fixed in the recess;

a socket which is supported on the inside of the stop body, and which is connected with the grip such that the socket is configured to rotate with the grip; and a fixing element configured to be fitted with the socket, wherein the fixing element includes a ring portion and radially inwardly extending teeth, the teeth being configured to allow insertion of the polygonal driver through the ring in a first axial direction and to directly engage with the polygonal driver located in the socket to prevent movement of the polygonal driver in a second axial direction opposite the first axial direction.

2. The actuating handle of claim 1 wherein the fixing element is positively connected to the socket.

3. The actuating handle of claim 1, wherein the fixing element is cohesively connected to the socket.

4. The actuating handle of claim 1, wherein the fixing element and the socket are unitarily formed as a single piece.

5. The actuating handle of claim 1, further comprising an anti-rotation arrangement, wherein the socket and the fixation element are prevented from rotating relative to one another.

6. The actuating handle of claim 1, wherein the socket is a detent socket, which cooperates with at least one locking projection formed on the stop body.

7. The actuating handle of claim 1, wherein the stop body comprises a neck lug configured to receive the socket; and wherein one of the socket and grip neck of the grip is selectively rotatable relative to the neck lug of the stop body.

8. The actuating handle of claim 1, wherein the stop body includes a cover coupled to the stop body.

9. An actuating handle for one of windows and doors, the actuating handle comprising:

a handle;

a polygonal driver having a proximate end and a distal end, the proximate end coupled to the handle;

a stop body defining a recess;

a socket arranged and configured within the recess, the socket configured to be selectively rotatively displaceable relative to the stop body;

the socket defining a through recess configured to receive the distal end of the polygonal driver;

an axially fixing element coupled to the socket such that rotation of the axially fixing element relative to the socket is prohibited, the axially fixing element defining a centered recess in communication with the through recess, the axially fixing element being a ring including radially-inwardly extending teeth which are configured to allow the distal end of the polygonal driver to pass through the centered recess in a first axial direction such that the polygonal driver is irrotationally coupled to the fixing element, but, once the polygonal driver has been inserted into the centered recess, the teeth are configured to directly engage the polygonal driver and not to allow the polygonal driver to be moved in a second axial direction due to engagement of the teeth contacting at least one side of the polygonal driver when the polygonal driver is urged in the second direction, the second direction being the opposite of the first direction; and wherein the handle is configured to selectively rotate the polygonal driver, which will in turn selectively rotate the socket with respect to the stop body.

10. The actuating handle of claim 9, wherein the axially fixing element and the socket are a unitary piece.

11. The actuating handle of claim 9, further comprising a cover coupled to the stop body.

12. The actuating handle of claim 9, wherein the stop body includes at least one latching projection, wherein the socket defines at least one arresting recess; and wherein the at least one latching projection and the at least one arresting recess are configured to interact in a detenting manner as the socket is selectively rotated with respect to the stop body.

13. The actuating handle of claim 12, wherein the stop body further includes at least one spring pin selectively displaceable away from the axially fixing element, and wherein the at least one latching projection is coupled to the at least one spring pin.

14. The actuating handle of claim 1, wherein the fixing element and the socket are a pre-mounted assembly.

15. The actuating handle of claim 1, wherein the teeth are configured to directly contact the polygonal driver.

16. The actuating handle of claim 7, wherein the socket is flush mounted to the neck lug.

* * * * *